US005303918A

United States Patent [19]

Liu

[11] Patent Number: 5,303,918

[45] Date of Patent: Apr. 19, 1994

[54] GAME RACKET HAVING INNOVATIVE STRINGED SURFACE

[76] Inventor: Wen-Chung Liu, No. 18, Alley 15, Lane 192, Sec. 1, Tung Shan Road, Taichung City, Taiwan

[21] Appl. No.: 998,028

[22] Filed: Dec. 29, 1992

[51] Int. Cl.[5] ..... A63B 51/10

[52] U.S. Cl. ..... 273/73 D; 273/73 R

[58] Field of Search ..... 273/73 R, 73 A, 73 C, 273/73 D, 73 L

[56] References Cited

U.S. PATENT DOCUMENTS

| | | | |
|---|---|---|---|
| 1,531,778 | 3/1925 | Gallaudet | 273/73 D |
| 4,249,731 | 2/1981 | Amster | 273/73 D |
| 4,273,331 | 6/1981 | Fischer | 273/73 D |
| 5,131,653 | 7/1992 | Yu | 273/73 R |

FOREIGN PATENT DOCUMENTS

| | | | |
|---|---|---|---|
| 715356 | 9/1931 | France | 273/73 D |

*Primary Examiner*—Vincent Millin
*Assistant Examiner*—Raleigh W. Chiu
*Attorney, Agent, or Firm*—Sheridan Neimark

[57] ABSTRACT

A game racket comprises a head, a shaft and a handle. The head is provided with a ball-striking surface comprising at least an elastic covering area which forms respectively on both sides of the ball-striking surface a covering plane serving to enhance the ball controllability of the ball-striking surface. The elastic covering area also serves to prevent the strings, which make up the ball-striking surface, from moving aside by a force of a ball impacting the ball-striking surface. The elastic covering area further serves the purpose of absorbing the shock wave generated by the impact of a ball on the ball-striking surface.

11 Claims, 6 Drawing Sheets

GAME RACKET HAVING INNOVATIVE STRINGED SURFACE

Field of the Invention

The present invention relates to a game racket, and more particularly to a game racket having a ball-striking stringed surface that is uniformly flat.

BACKGROUND OF THE INVENTION

As shown in FIGS. 1–3, a prior art game racket 10 comprises a head 11, a handle 14, and a shaft 15 bridging the head 11 and the handle 14. The head 11 is composed of a ball-striking surface 13, which is formed by a network of longitudinal strings 12 and horizontal strings 12 passing respectively through string holes 16 in the head 11.

The ball-striking surface 13 is composed of a number of intersections 17 formed by the longitudinal strings 12 and the horizontal strings 12. Within the effective area of the ball-striking surface 13, the distance between the two intersections 17 is on the order of 11–18 mm, with each of the longitudinal segment 12' and the horizontal segment 12'', which are adjacent to the intersection 17, having its own inclination direction and inclination rate or angle. Upon hitting a ball, the ball-striking surface 13 is distorted by a force. As a result, the ball and the ball-striking surface 13 form a contact area of a predetermined size. The size of the contact area depends on the speed of the ball that hits the ball-striking surface 13, ranging between the area formed by the four intersections a, b, c and d and the area formed by the four intersections a, b', c', and d'. If the ball hits the ball-striking surface 13 vertically, the ball will be returned by traveling in the direction of the normal vector S, as shown in FIG. 1.

When the mass center of the ball is normal to the intersections 17 *a, b, c* and *d*, the ball that hits the ball-striking surface 13 is returned in the direction of the normal vector S. The departing direction of a ball depends, to a great extent, on the contact point of the mass center of the ball. However, when the mass center of the ball makes contact with the strings 12' and 12'' which have predetermined inclination rates such as f and g, as shown in FIG. 2, the ball will be returned in a direction that deviates a predetermined angle from the normal vector S. As a result, there will be an angular differential between the ball-striking direction of the racket 10 and the direction in which the ball travels. When a person swings the racket 10 in an attempt to strike the ball, it is very likely that the mass center of the ball makes contact with the strings 12' and 12'' rather than the intersections 17. As a result, the ball that is returned often travels in a direction deviating a predetermined angle from the direction in which the racket 10 is swung. In other words, it is often difficult for a player to control the precise direction of return of such a ball.

Upon striking an incoming ball, the strings 12 making up the ball-like surface 13 are forced to move or spread aside, as shown in FIG. 4. As a result, the different strings 12 of the ball-striking surface 13 have different tensions. In addition, there is thus created a variation in the number of strings in any per unit area of the ball-striking surface 13. That is to say that the ball-striking surface 13 will not strike the ball uniformly over its entire area.

The prior art methods of reducing the transmission of the shock wave generated by the strings 12 of the ball-striking surface 13 are often ineffective. The shortcomings of the prior art racket 10 described above are true not only with a tennis racket but also with a badminton racket, a squash racket and the like.

SUMMARY OF THE INVENTION

It is, therefore, the primary objective of the present invention to provide a game racket with a ball-striking surface that is uniformly flat, so as to afford better control to a player using such a game racket.

It is another objective of the present invention to provide a game racket with a ball-striking surface which is capable of exerting uniform force against an incoming ball.

It is still another objective of the present invention to provide a game racket with a ball-striking surface capable of absorbing shock effectively.

In keeping with the principles of the present invention, the foregoing objectives of the present invention are accomplished by a game racket having an innovative stringed surface. The game racket comprises a head, a handle, and a shaft bridging the head and the handle. The head has a stringed surface provided with a ball-striking surface, which is composed of at least an elastic covering area comprising a covering plane, with the elastic covering area being a network configuration mitigating any wind resistance created by the elastic covering area.

The covering plane is responsible for making the ball-striking surface uniformly flat, so as to afford a player holding the racket a better control of a ball hitting the ball-striking surface. In addition, such covering plane serves to ensure that the intersections formed by the cross and the longitudinal strings are so held securely in place as to prevent the strings from moving aside at such time when the strings make contact with an incoming ball. Moreover, the elastic covering area is provided with means capable of absorbing shock.

DETAILED DESCRIPTION OF THE PREFERRED EMBODIMENTS

Figure 1:
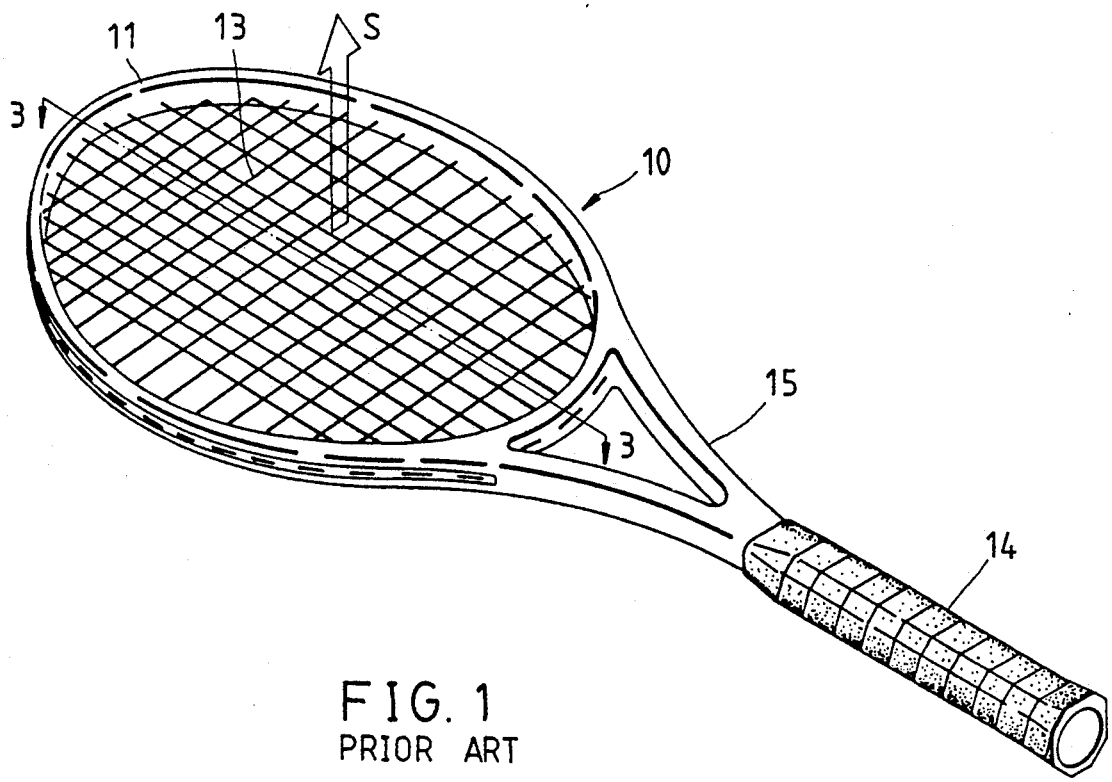
FIG. 1 PRIOR ART
FIG. 1 shows a perspective view of a prior art game racket.
Figure 4:
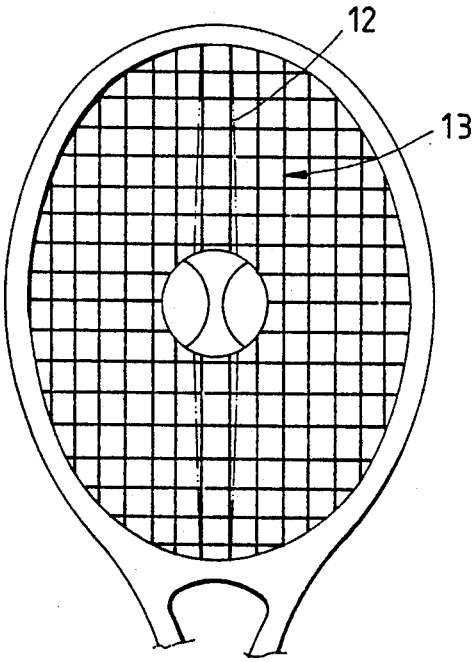
FIG. 4 PRIOR ART
FIG. 4 is a schematic view showing that the strings move aside at such time when the strings are exerted upon by a force of an incoming ball.
Figure 3:
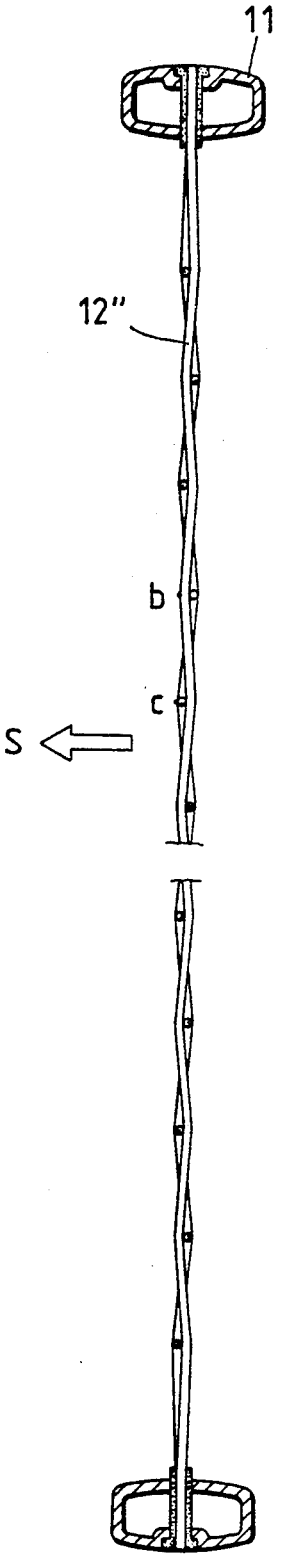
FIG. 3 PRIOR ART
FIG. 3 shows a sectional view of a portion taken along a line 3—3 as shown in FIG. 1.
Figure 2:
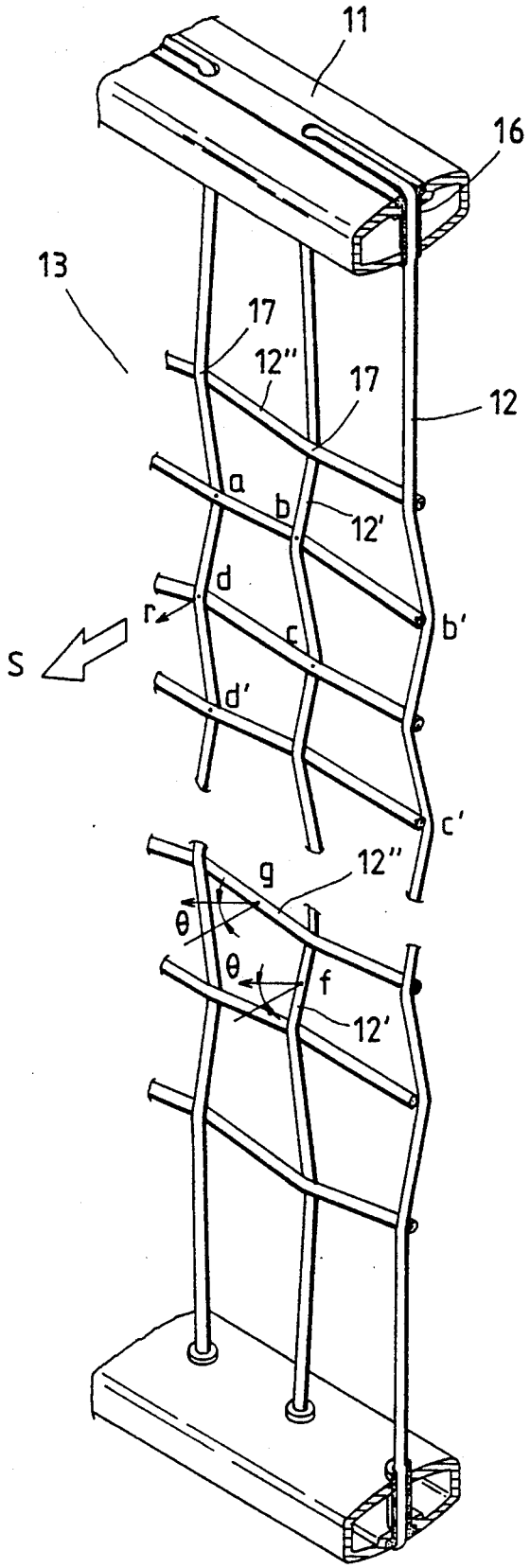
FIG. 2 PRIOR ART
FIG. 2 is a partial enlarged view of the prior art game racket as shown in FIG. 1.

Referring to FIGS. 5–8, a game racket 20 is shown to comprise a head 21 of an annular construction, a handle 22, and a shaft 23 connecting the head 21 with the handle 22. The head 21 has a ball-striking surface 24 formed by a plurality of longitudinal and cross strings 27 and 28, which are interlaced vertically to form a predetermined number of intersections 30. The head 21 further forms a ball-striking plane 32, namely the plane defining the circular head 21 of the game racket. The ball-striking surface 24 is provided with an elastic covering area 40 forming a covering plane 48 parallel to the ball-striking plane 32.

Figure 7:
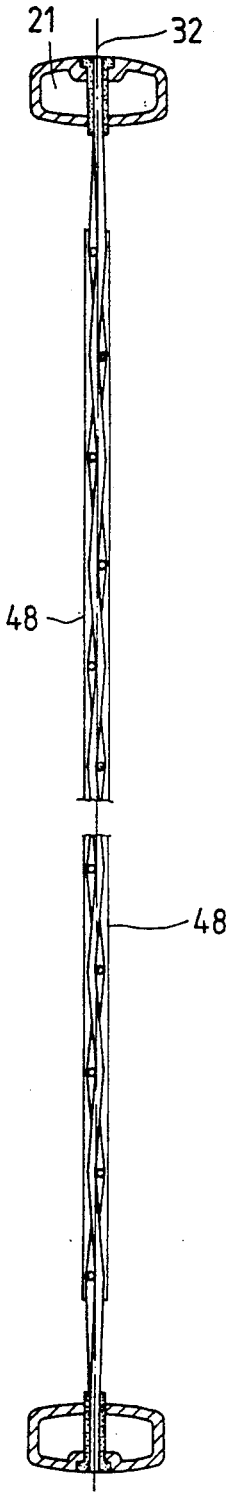
FIG. 7 shows a sectional view of a portion taken along a line 7—7 as shown in FIG. 5.
Figure 6A:
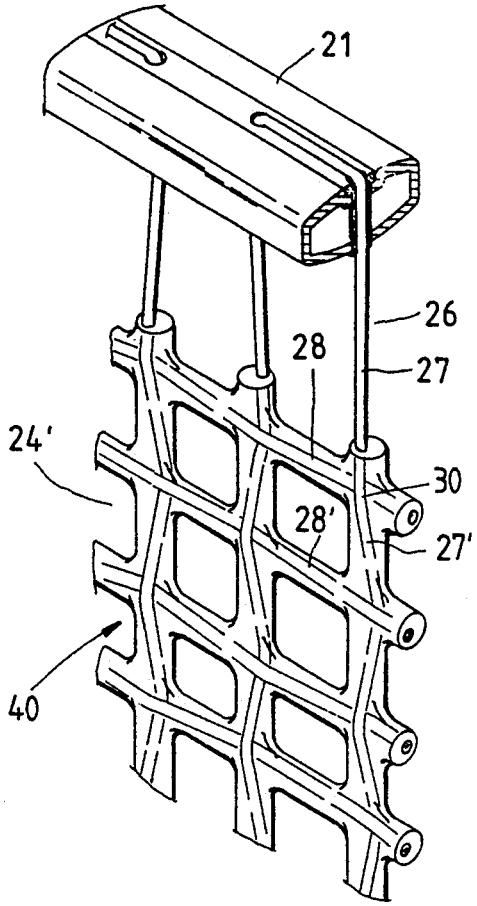
FIG. 6A shows a partial enlarged view of the game racket as shown in FIG. 5.

As shown in FIGS. 6A and 7, a longitudinal string segment 27' and a cross string segment 28', which are interlaced to form an intersection 30, are so arranged that they meet at a predetermined angle.

The elastic covering area 40 refers to those strings 26 which are individually sheathed with a covering body 42 (see FIG. 6B) to form a network of the ball-striking surface 24 of the head 21. The strings 26 are interlaced in a manner that they form a network core of the ball-striking surface 24, with strings 26 spaced at an interval. In other words, the elastic covering area 40 is defined by the network sheathing which covers the intersecting strings 27 and 28; thus, the elastic covering area 40 covers what would otherwise be the ball-striking surface 24 by covering each string 26 along its length so as to form between adjacent and crossing strings an open space similar to a mesh of a network.

Figure 6B:
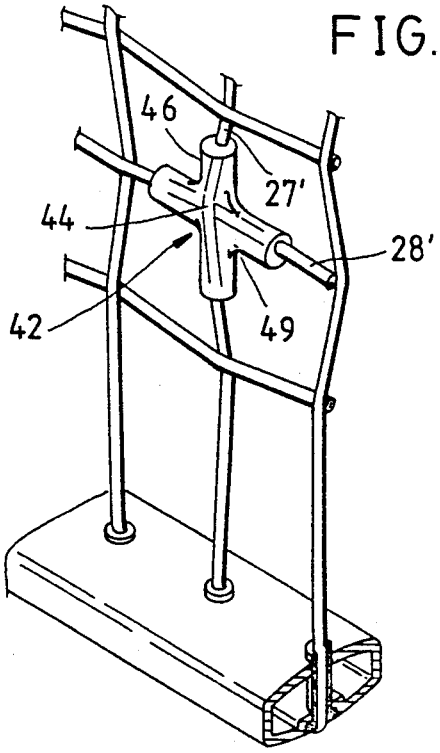
FIG. 6B shows a similar view broken away to show a detail.
Figure 5:
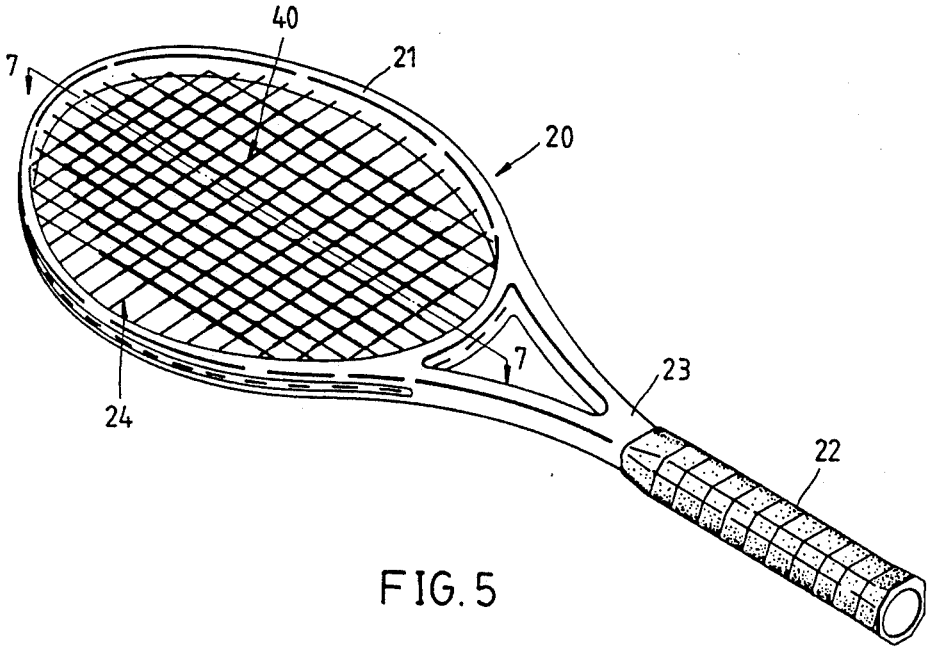
FIG. 5 shows a perspective view of a game racket of the present invention.
Figure 8:
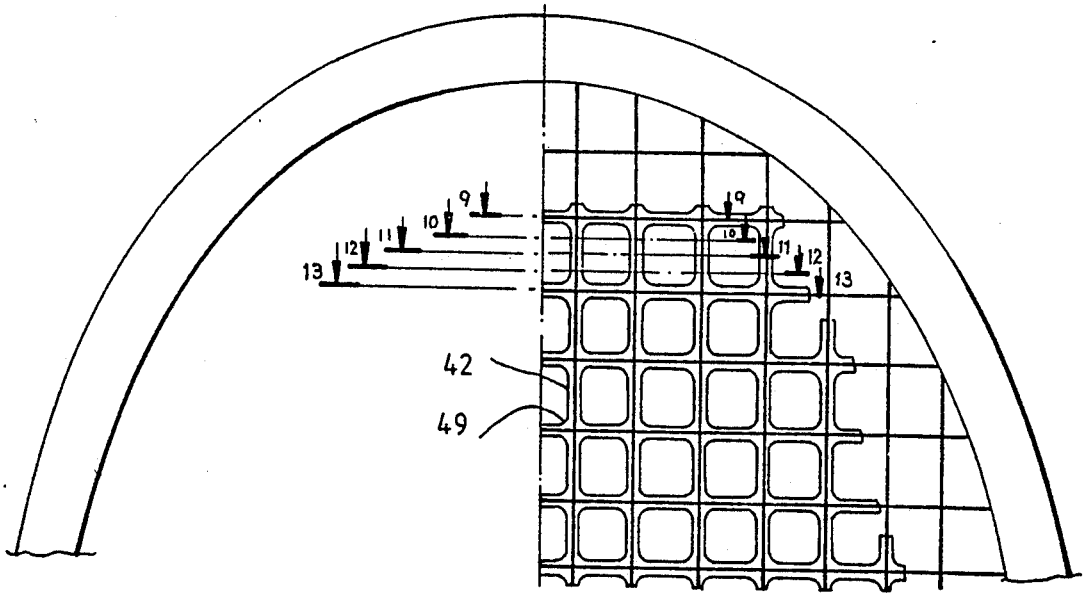
FIG. 8 shows a partial front view of the game racket as shown in FIG. 5.
Figure 9:
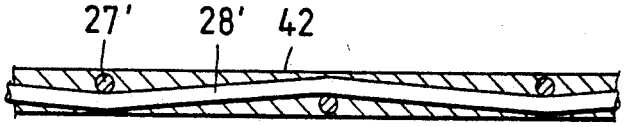
FIGS. 9–13 show sectional views of the portions taken along the lines as shown in FIG. 8.
Figure 10:
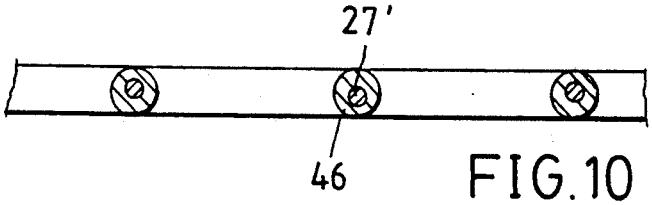
Figure 11:
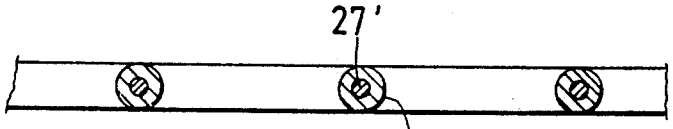
Figure 12:
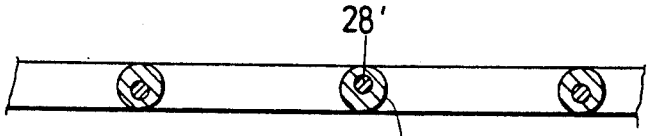
Figure 13:
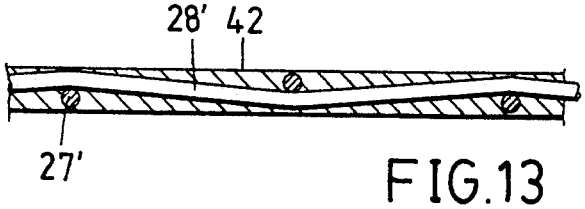

The covering body 42 is made of a plastic material or a neoprene material which has an appropriate toughness. The covering body 42 is of a cross shaped construction and composed of a body portion 44 covering the central portion, i.e. the intersection 30, and four foot portions 46 extending therefrom and enclosing respectively the four string segments 27' and 28' as seen in FIG. 6B. The covering bodies 42 collectively form the covering area 40.

The foot portions 46 of the covering body 42 are circular in cross section and should have an outer diameter that is preferably 2.1 to 2.4 times greater than the outer diameter of the strings 26. In addition, the covering body 42 is reinforced at its body portion 44 by a reinforcing body 49 located at the junction between the two foot portions 46, such reinforcing body 49 being in the form of arcuate portions extending between adjacent foot portions 46 in the illustrated embodiment of FIG. 6B.

The way that the covering body 42 contains the string segments 27' and 28' is illustrated in FIGS. 9–13. The covering body 42 is so arranged that a covering plane 48 (see FIG. 7) is formed between the two ends of the ball-striking surface 24. Each covering plane 48 so formed is parallel to the ball-striking plane 32 of the head 21.

Figure 14:
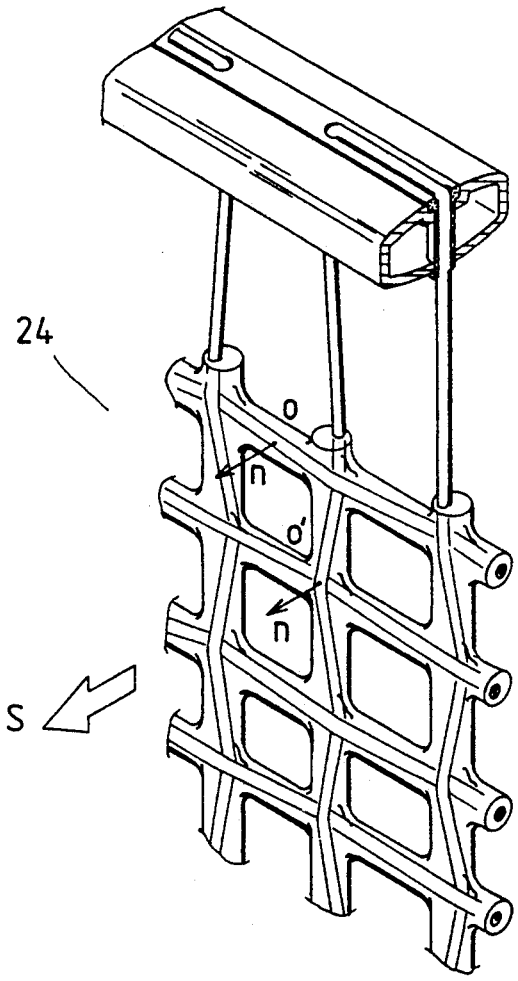
FIG. 14 is a schematic view showing the ball-striking points in relation to the strings, according to the present invention.

The stringed surface of the game racket 20 of the present invention is flat uniformly, in view of the fact that the covering plane 48 of the elastic covering area 40 is parallel to the ball-striking plane 32 of the ball-striking surface 24. In other words, the covering plane 48 has a uniform inclination rate, i.e. it is uniformly flat. As shown in FIG. 14, the mass center of a ball always makes contact with the covering plane 48 having a uniform inclination rate, even if the mass center of the ball hits an intersection 30 or a 0 point or a 0' point of any string 26. As a result, the ball is returned in a direction which is designated as n and is consistent with the normal vector S of the ball-striking surface 24. Therefore, the game racket 20 of the present invention affords a player holding the racket better control for return of a ball struck by the racket.

The covering body 42, which is reinforced by a reinforcing body 49, serves to hold the intersection 30 securely in place so as to prevent the strings 26 from moving aside at such time when the ball-striking surface 24 is hit by a ball. In other words, the strings 26 making up the ball-striking surface 24 are impacted uniformly by the ball.

The covering body 42 is made of a material having an appropriate toughness and is therefore capable of absorbing directly the impact energy of the ball. In addition, the elastic covering area 40 covers a wide area of the stringed surface of the game racket 20, thereby further enhancing the shock-absorbing effectiveness of the game racket.

Figure 15:
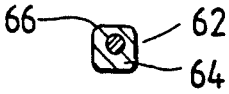
FIG. 15 shows a cross-sectional view of a covering body of another preferred embodiment of the present invention.

Now referring to FIG. 15, a covering body 62 of another preferred embodiment of the present invention is shown comprising a foot portion 64, which is different from the foot portion 46 of the first preferred embodiment of the present invention in that it is rectangular in its cross section and that it has four arcuate corners 66. Such structural design of the covering body 62 gives an added effectiveness in the ball controllability of the covering plane of the game racket.

It must be noted here that the elastic covering area of the present invention is not confined to the sweet spot of the game racket and that the elastic covering area may be disposed in the entire area of the ball-striking surface of the game racket. The covering bodies 42, 62 forming the covering area may be formed by placing the strung racket in a suitable injection molding die, and injecting the covering plastic or rubber over the strings.

Furthermore, the covering body embodied in the present invention may be made of an appropriate material of transparent quality, with a view to giving a deceptive impression that the strings are not enclosed in the covering body, as shown in FIGS. 6 and 14. The covering bodies having a relatively small outer diameter may be used if the strings of a great strength having a relatively small outer diameter are used to construct the stringed surface of the game racket.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A game racket having innovative stringed surface, said racket comprising:

a head, a handle, and a shaft bridging said head and said handle, with said head having a ball-striking surface formed by a plurality of interlaced strings and provided with a predetermined number of intersections;

said ball-striking surface of said game racket having means for enhancing controllability of a ball hitting said ball-striking surface and preventing stacked strings from moving aside so as to absorb directly an impact of the ball, wherein said ball-striking surface is composed of at least an elastic covering comprising a predetermined number of covering bodies, each of which encloses therein two cross string segments and two longitudinal string segments and which further encloses an intersection formed by said cross string segments and said longitudinal string segments, so as to form a covering plane in said elastic covering of a network configuration;

wherein said elastic covering comprises a predetermined number of interconnected covering bodies, each of which covers an intersection and a longitudinal string segment adjacent to said intersection and a horizontal string segment adjacent to said intersection in a manner that said covering bodies are aligned with at least one side of said ball-striking surface.

2. The game racket of claim 1 wherein each of said covering bodies comprises a body portion covering said intersection, and four foot portions enclosing respectively aid two cross string segments adjacent to said intersection and said two longitudinal string segments adjacent to said intersection, with the junction formed by two adjacent foot portions being reinforced by a reinforcing body.

3. The game racket of claim 1 wherein said elastic covering area covers the entire area of said ball-striking surface.

4. The game racket of claim 1 wherein said elastic covering is made up of a plastic material or a rubber material.

5. the game racket of claim I wherein said elastic covering comprises respectively a covering plane on both sides of said ball-striking surface.

6. The game racket of claim 1 wherein each of said covering bodies is circular in its cross section.

7. The game racket of claim 1 wherein each of said covering bodies is rectangular in its cross section and has four arcuate corners.

8. The game racket of claim 1 wherein each of said covering bodies has a cross section with an outer diameter that is 2.1 to 2.4 times greater than an outer diameter of said strings making up said ball-striking surface.

9. A game racket according to claim 1, wherein said plurality of strings forming said ball-striking surface cross one another at said intersection providing stacked and inclined strings, and wherein said elastic covering surrounds each said string as a layer of non-uniform thickness in a manner compensating for inclinations of the strings so as to provide said elastic covering in the form of said covering plane which is substantially uniformly flat.

10. A game racket having innovative stringed surface, said racket comprising a head, a handle, and a shaft bridging said head and said handle, with said head having a ball-striking surface formed by a plurality of strings and provided with a predetermined number of intersections; wherein said ball-striking surface of said game racket is characterized in that said ball-striking surface is composed of at least an elastic covering area comprising a predetermined number of covering bodies, each of which encloses therein two cross string segments and two longitudinal string segments and which further encloses an intersection formed by said cross string segments and said longitudinal string segments, so as to form a covering plane in said elastic covering area of a network configuration; wherein said elastic covering area comprises a predetermined number of interconnected covering bodies, each of which covers an intersection and a longitudinal string segment adjacent to said intersection and a horizontal string segment adjacent to said intersection in a manner that said covering bodies are aligned with at least one side of said ball-striking surface; wherein said covering plane of said elastic covering area serves to enhance the controllability of a ball hitting said ball-striking surface; and wherein said elastic covering area prevents stacked strings from moving aside and absorbs directly an impact of said ball;

wherein said covering plane is parallel to a ball-striking plane of said head.

11. A game racket having innovative stringed surface, said racket comprising a head, a handle, and a shaft bridging said head and said handle, with said head having a ball-striking surface formed by a plurality of strings and provided with a predetermined number of intersections; wherein said ball-striking surface of said game racket is characterized in that said ball-striking surface is composed of at least an elastic covering area comprising a predetermined number of covering bodies, each of which encloses therein two cross string segments and two longitudinal string segments and which further encloses an intersection formed by said cross string segments and said longitudinal string segments, so as to form a covering plane in said elastic covering area of a network configuration; wherein said elastic covering area comprises a predetermined number of interconnected covering bodies, each of which covers an intersection and a longitudinal string segment adjacent to said intersection and a horizontal string segment adjacent to said intersection in a manner that said covering bodies are aligned with at least one side of said ball-striking surface; wherein said covering plane of said elastic covering area serves to enhance the controllability of a ball hitting said ball-striking surface; and wherein said elastic covering area prevents stacked strings from moving aside and absorbs directly an impact of said ball;

wherein said elastic covering area covers said ball-striking surface in a manner that the margin of said elastic covering area remains apart from the inner edge of a frame forming said head.

* * * * *